US006385892B1

(12) United States Patent
Vendetti

(10) Patent No.: US 6,385,892 B1
(45) Date of Patent: May 14, 2002

(54) BAYONET LUG CLAMP AND MOUNT ASSEMBLY

(75) Inventor: Vincent J. Vendetti, Fredericksburg, VA (US)

(73) Assignee: The United States of America as represented by the Secretary of the Navy., Washington, DC (US)

( * ) Notice: Subject to any disclaimer, the term of this patent is extended or adjusted under 35 U.S.C. 154(b) by 0 days.

(21) Appl. No.: 09/585,802

(22) Filed: May 31, 2000

(51) Int. Cl.[7] ..... F41C 27/00; F41C 27/18
(52) U.S. Cl. ..... 42/86; 42/86; 42/90
(58) Field of Search ..... 42/86, 90, 105, 42/146, 115, 114

(56) References Cited

U.S. PATENT DOCUMENTS

| | | | | | |
|---|---|---|---|---|---|
| ,398,130 | A | * | 2/1889 | Cooper et al. | 42/86 |
| ,613,241 | A | * | 11/1898 | Burton | 42/86 |
| ,716,158 | A | * | 12/1902 | Wheeler | 42/86 |
| 2,367,212 | A | * | 1/1945 | Hagg | 42/86 |
| 3,548,709 | A | * | 12/1970 | Prince | 42/105 |
| 4,539,769 | A | * | 9/1985 | Stevens et al. | 42/115 |
| 4,571,870 | A | * | 2/1986 | Heideman et al. | 42/114 |
| 4,580,362 | A | * | 4/1986 | Stevens | 42/114 |
| 4,689,911 | A | | 9/1987 | White | 42/105 |
| 5,092,071 | A | * | 3/1992 | Moore | 42/86 |
| 5,198,600 | A | | 3/1993 | E'Nama | 42/90 |
| 5,282,594 | A | * | 2/1994 | Huang | 42/114 |
| 5,590,484 | A | | 1/1997 | Mooney et al. | 42/100 |
| 5,594,967 | A | * | 1/1997 | Morton et al. | 42/86 |
| 5,737,866 | A | | 4/1998 | Minaire et al. | 42/90 |
| 5,826,363 | A | | 10/1998 | Olson | 42/75.01 |
| 5,930,935 | A | * | 8/1999 | Griffin | 42/105 |
| 6,134,823 | A | * | 10/2000 | Griffin | 42/86 |

FOREIGN PATENT DOCUMENTS

| | | | | |
|---|---|---|---|---|
| DE | 85193 A1 | * | 12/1982 | 42/105 |
| EP | WO 88/07167 | * | 9/1988 | 42/86 |
| GB | 2168795 A | * | 6/1986 | 42/105 |

* cited by examiner

*Primary Examiner*—Michael J. Carone
*Assistant Examiner*—Lulit Semunegus
(74) *Attorney, Agent, or Firm*—James B. Bechtel, Esq.; Peter J. Van Bergen, Esq.

(57) ABSTRACT

A bayonet lug clamp and mount assembly is provided for use with a rifle having a T-shaped bayonet lug with slots formed in a central portion thereof. A housing is configured to slidingly engage the bayonet lug. A lever incorporating an accessory mounting rail is pivotally coupled to the housing for movement towards and away therefrom. A jaw is movably mounted in the housing and has teeth that are aligned with the slots in the bayonet lug when the housing is slid thereon. A piston/cylinder assembly is coupled to the lever and to the jaw. When the lever is pivoted towards the housing with the teeth aligned with the slots in the bayonet lug, the piston/cylinder assembly presses the jaw against the bayonet lug as the teeth engage the slots. The lever can be locked to the housing in order to assure that the clamp does not move when the rifle is fired.

18 Claims, 6 Drawing Sheets

FIG.1A
PRIOR ART
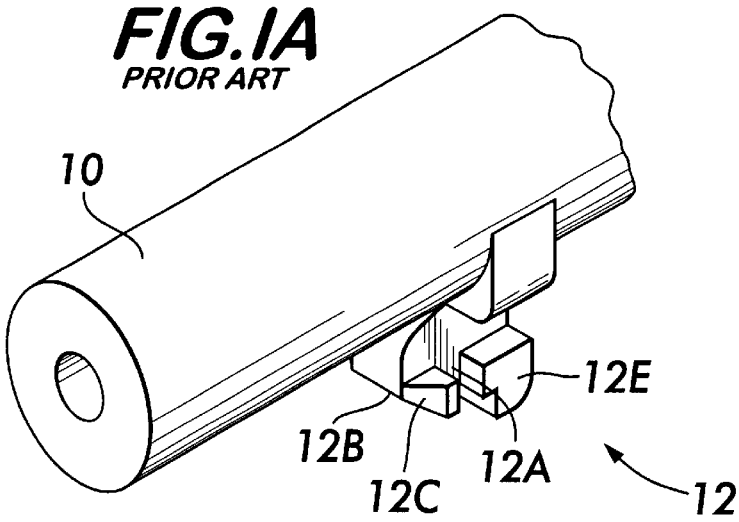
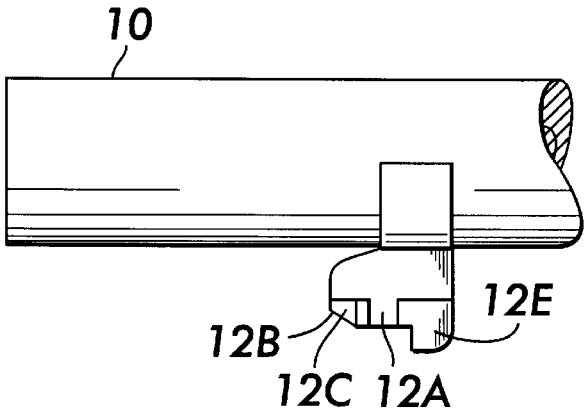
FIG.1B
PRIOR ART
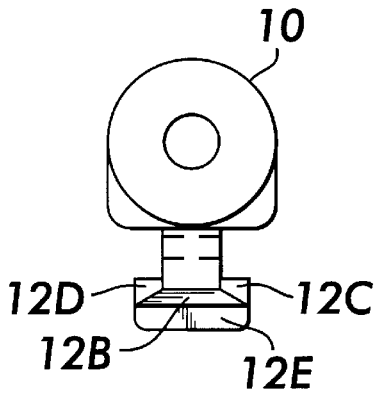
FIG.1C
PRIOR ART
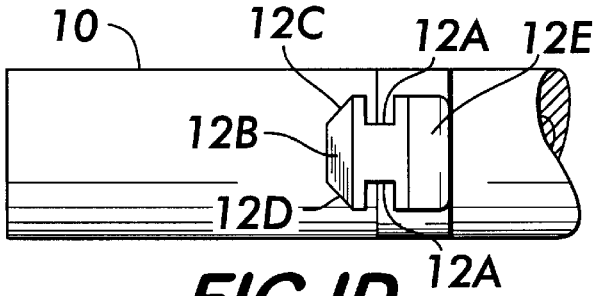
FIG.1D
PRIOR ART

BAYONET LUG CLAMP AND MOUNT ASSEMBLY

ORIGIN OF THE INVENTION

The invention described herein was made in the performance of official duties by an employee of the Department of the Navy and may be manufactured, used, licensed by or for the Government for any governmental purpose without payment of any royalties thereon.

FIELD OF THE INVENTION

The invention relates generally to the mounting of accessories on a rifle, and more particularly to a clamp that supports an accessory and rigidly clamps onto the bayonet lug of a rifle.

BACKGROUND OF THE INVENTION

Military rifles such as the M-16 are used in a wide variety of operational situations. Each rifle is typically equipped with a lug near its muzzle end for the mounting of a bayonet. However, some situations may require the use of different rifle accessories such as a flashlight, a laser sighting device, a scope, etc. Optimal positioning of many of these accessories is near the muzzle end of the rifle. Accordingly, attachment of such accessories using the rifle's bayonet lug is desirable. Attachment could be accomplished by coupling the accessory directly to the bayonet lug via a coupling or clamp. Alternatively, the accessory could be mounted to a universal mounting rail that is clamped onto the bayonet lug. For example, there is an accessory mounting rail (manufactured in accordance with Military Standard 1913) designed to serve as the attachment point for a number of different accessory devices.

The accessory or accessory mounting rail should be easily and quickly attachable to a rifle without the need for any tools or any modification of the rifle. Further, once mounted, the accessory or accessory mounting rail should be secure and maintain its position after the rifle is fired.

SUMMARY OF THE INVENTION

Accordingly, it is an object of the present invention to provide a clamp that securely attaches to the bayonet lug of a rifle.

Another object of the present invention is to provide a clamp that can be attached to a rifle's bayonet lug without the use of any tools or modification of the rifle while supporting an accessory or accessory mounting rail.

Still another object of the present invention is to provide a clamp that attaches to a rifle's bayonet lug and maintains its position after the rifle is fired.

Other objects and advantages of the present invention will become more obvious hereinafter in the specification and drawings.

In accordance with the present invention, a bayonet lug clamp for use with a rifle having a T-shaped bayonet lug with slots formed in a central portion thereof. A housing is configured to slidingly engage the T-shaped bayonet lug. A lever is pivotally coupled to the housing for movement towards and away therefrom. A jaw, movably mounted in the housing, has teeth protruding therefrom. The teeth are aligned with the slots in the bayonet lug when the housing is slid thereon. A piston/cylinder assembly has its cylinder pivotally coupled to the lever and its piston slidingly supported partially within the cylinder and coupled to the jaw.

When the lever is pivoted towards the housing with the teeth aligned with the slots in the bayonet lug, the piston/cylinder assembly presses the jaw against the bayonet lug as the teeth engage the slots. The lever can be locked to the housing in order to assure that the clamp does not move when the rifle is fired. In terms of using the present invention as a mount assembly, the lever can incorporate an accessory mounting rail so that a variety of rifle attachments can be coupled thereto when the clamp is locked onto the rifle's bayonet lug.

BRIEF DESCRIPTION OF THE DRAWINGS

FIG. 1A is a perspective view of the muzzle end of an M-16 rifle to include the rifle's bayonet lug;

FIG. 1B is a side view of the muzzle end and bayonet lug;

FIG. 1C is a front view of the muzzle end and bayonet lug;

FIG. 1D is a bottom view of the muzzle end and bayonet lug;

DETAILED DESCRIPTION OF THE INVENTION

Figure 2:
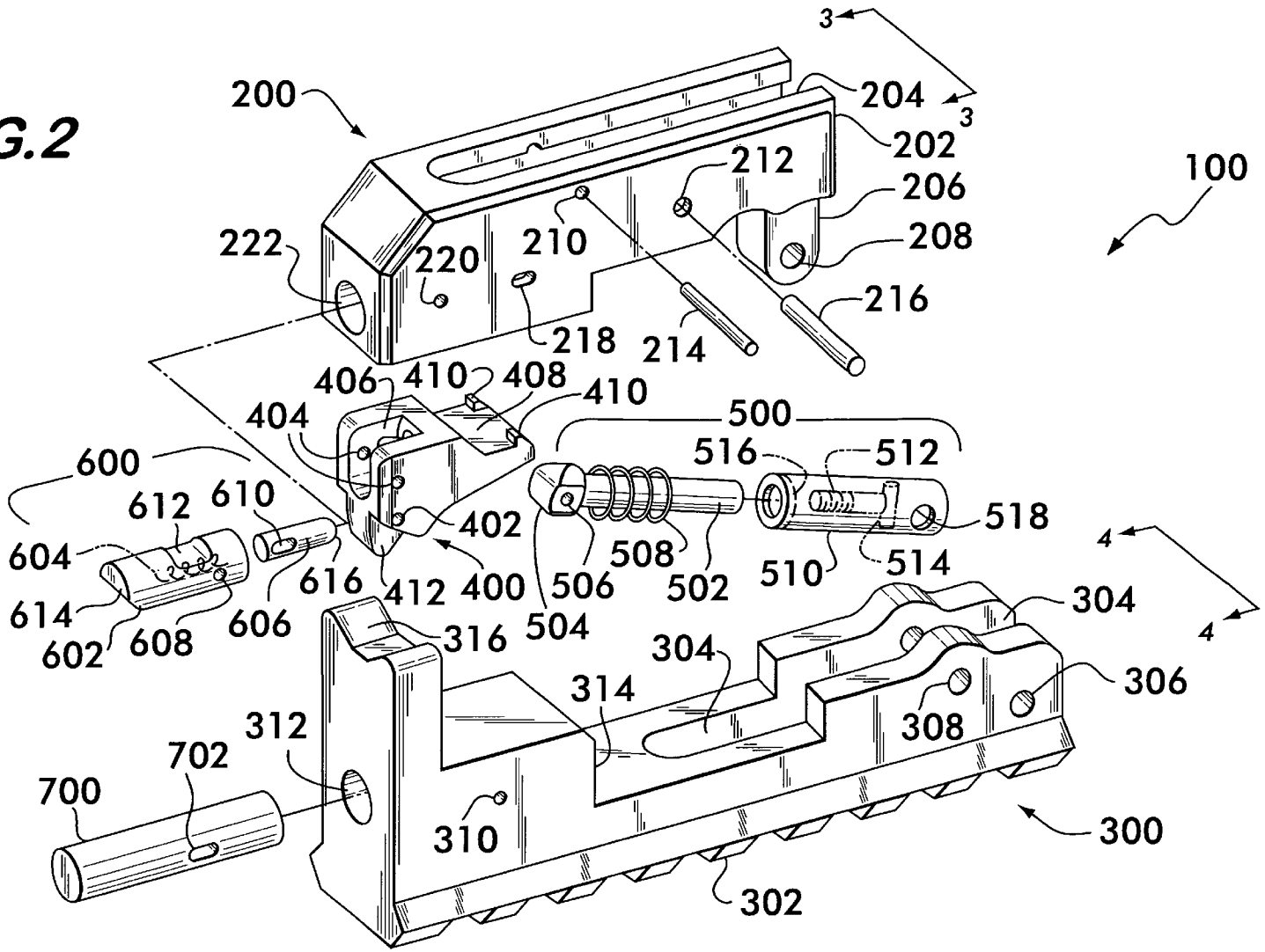
FIG. 2 is an exploded perspective view of the bayonet lug clamp and mount assembly according to an embodiment of the present invention.

Referring now to the drawings, and more particularly to FIGS. 1A–1D, various views are shown of the muzzle end 10 and a rigid bayonet lug 12 of an M-16 rifle. Identical reference numbers will be used for the same elements in the various views. Owing to its widespread use in a variety of military applications, the M-16 rifle will be described by way of example as the point of attachment for an accessory or an accessory mounting rail. However, as will be readily apparent to one of ordinary skill in the art, the present invention can be adapted to work with any firearm having a bayonet lug located near its muzzle.

Muzzle end 10 is cylindrical as would be the case for most firearms. Bayonet lug 12 is mounted or attached to the underside of the rifle and rearward of muzzle end 10. Along its length, bayonet lug 12 is substantially an inverted T-shape except for opposing slots 12A formed on either side thereof in a central portion of bayonet lug.12. Forward of slots 12A, the lower portion of the T-shape of bayonet lug 12 is swept angularly rearward from the front 12B and at the left and right sides 12C and 12D, respectively. Rearward of slots 12A, the inverted T-shape is continued at 12E.

The bayonet lug clamp and mount assembly of the present invention will now be explained with the aid of FIGS. 2–7 where FIG. 2 depicts an exploded view of the bayonet lug clamp and mount assembly that is referenced generally by numeral 100. In FIG. 2, all parts of the bayonet lug clamp and mount assembly are illustrated except for the pins used to couple the parts to one another. These have been omitted from FIG. 2 for clarity of illustration. Identical reference numbers will be used for the same elements in the various views.

Assembly 100 has a bayonet lug receiving housing 200, a lever 300 that can be coupled directly to a rifle accessory (not shown) or have an accessory mounting rail coupled thereto a jaw 400 for engagement with a bayonet lug (e.g., bayonet lug 12 described above), a piston/cylinder assembly 500, a plunger assembly 600, and an unlocking button 700.

Figure 3:
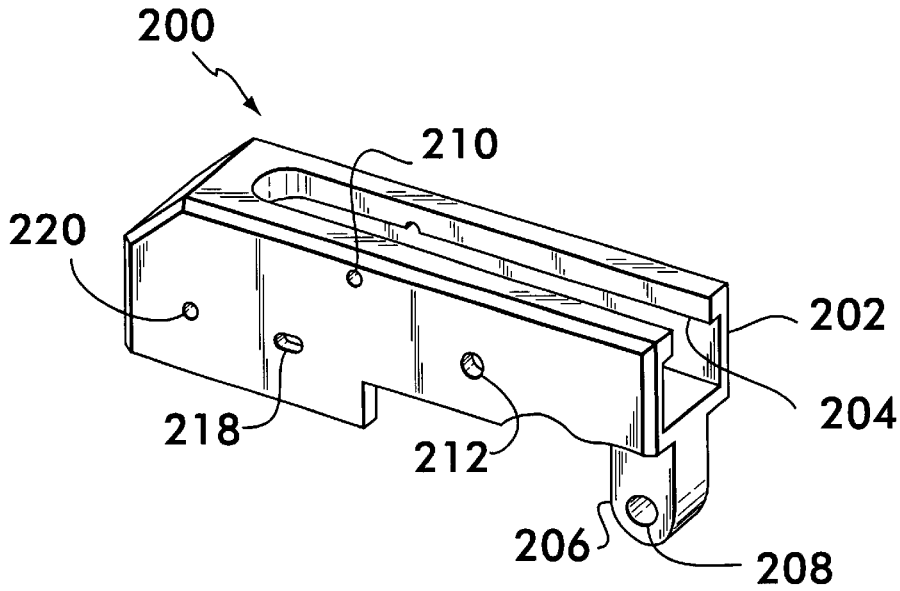
FIG. 3 is an isolated perspective view of the bayonet lug receiver housing taken from line 3—3 in FIG. 2.

Housing 200 will be explained with simultaneous reference to FIG. 3 which depicts housing 200 in a perspective view taken from line 3—3 in FIG. 2. Housing 200 is a rigid part open at one end 202 and formed with an elongated slot 204 starting at end 202. Slot 204 has a cross-sectional shape that is complimentary to the bayonet lug it is to be used with. For example, in terms of bayonet lug 12, slot 204 is configured as an inverted T-shape to slidingly receive bayonet lug 12 therein. A hinge portion 206 having a hinge pin hole 208 is provided at end 202 to receive a hinge pin (not shown in FIG. 2) that allows housing 200 to be pivotally coupled to lever 300 as will be explained further below.

A plurality of transverse through holes are provided in housing 200. Holes 210 and 212 can be provided to receive stop pins 214 and 216, respectively. Pin 214 is positioned as a pivot stop for jaw 400 as will be explained further below. Pin 216 is positioned such that it will contact an aft portion (e.g., portion 12E) of bayonet lug 12 as housing 200 is slid thereon in order to properly position assembly 100 relative to bayonet lug 12.

Another transverse through hole in housing 200 is slotted hole 218 which is aligned with a hole in jaw 400 during assembly. Jaw 400 is placed in slot 204 and a pivot/mounting pin (not shown in FIG. 2) is used to pivotally couple jaw 400 to housing 200. Slotted hole 218 allows jaw 400 to pivot within housing 200 and slide fore and aft within housing 200. As will be explained further below, the sliding movement of jaw 400 allows the present invention to tolerate imperfections in bayonet lug 12.

Transverse hole 220 perpendicularly intersects an axial sleeve 222 formed in a solid portion of housing 200. Axial sleeve 222 is sized to slidingly receive plunger assembly 600. Transverse hole 220 receives a mounting pin (not shown in FIG.2) that also cooperates with plunger assembly 600 as will be explained further below.

Figure 4:
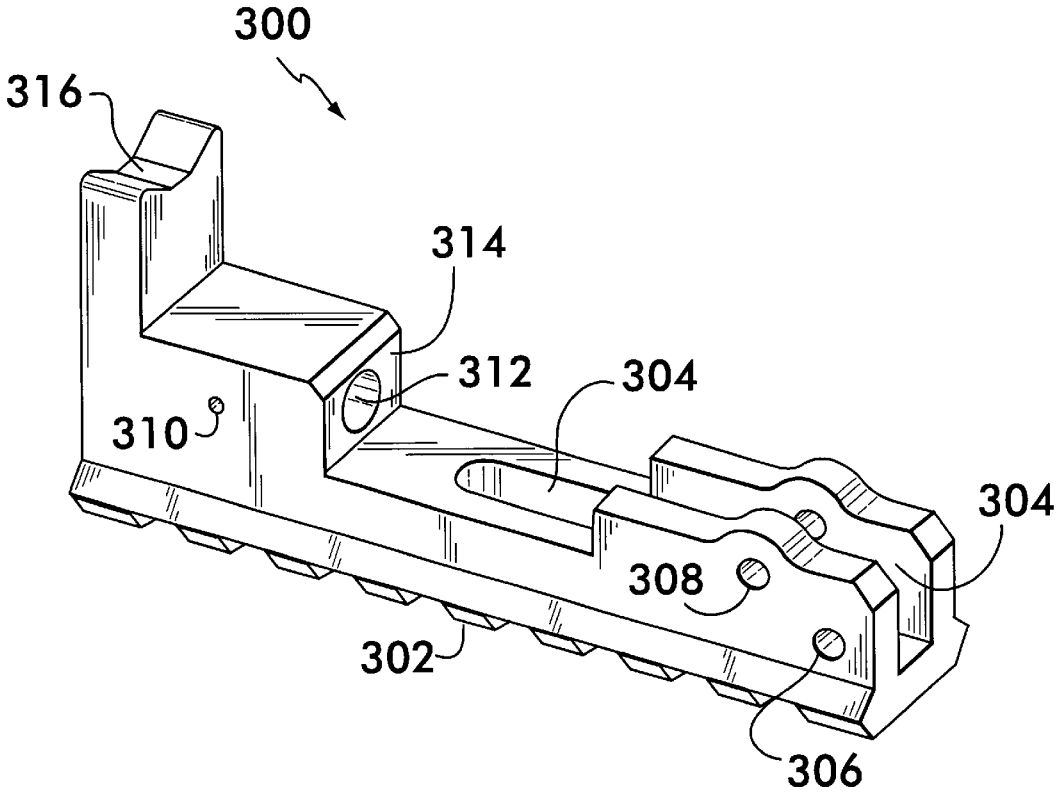
FIG. 4 is an isolated perspective view of the lever/accessory mounting rail taken from line 4—4 in FIG. 2.

Lever 300 will be explained with simultaneous reference to FIG. 4 which depicts lever 300 in a perspective view taken from line 4—4 in FIG. 2. As mentioned above, lever 300 could have an accessory coupled directly thereto or could incorporate an accessory mounting rail. By way of illustrative example, lever 300 incorporates an accessory mounting rail 302 on its underside. Typically, lever 300 would be constructed as a single rigid part that incorporates accessory mounting rail 302 as part thereof.

Accessory mounting rail 302 can be any rail on which rifle or other mission-specific accessories (e.g., light(s), laser sighting device, scope(s), bayonet, etc.) are easily mounted. For example, accessory mounting rail 302 can be made in accordance with Military Standard 1913 (MIL-STD-1913) which defines the dimensions and specifications for the most widely used accessory mounting rail. Details related to accessory mounting rail 302 are well known in the art and, therefore, will not be described further herein.

Lever 300 has an axial slot 304 formed therein and sized to receive hinge portion 206 of housing 200 and piston/cylinder assembly 500. A first transverse hole 306 extending across lever 300 aligns with hinge pin hole 208 when hinge portion 206 is fitted in slot 304. A hinge pin (not shown in FIG. 2) passes through aligned hole 208 and 306 so that housing 200 and lever 300 can pivot towards and away from one another.

A second transverse hole 308 extends across lever 300 and aligns with a hole provided in piston/cylinder assembly 500. Another hinge pin (not shown in FIG. 2) passes through hole 308 and piston/cylinder assembly 500 so that assembly 500 can pivot towards and away from lever 300.

A third transverse hole 310 perpendicularly intersects an axial sleeve 312 formed in a solid portion of lever 300. For reasons that will become apparent, axial sleeve 312 is aligned with sleeve 222 when housing 200 is pivoted to lever 300. Axial sleeve 312 is sized to slidingly receive button 700. Transverse hole 310 receives a mounting pin (not shown in FIG. 2) that also passes through button 700. Specifically, button 700 has a through slot 702 so that button 700 can move freely in an axial direction in sleeve 312.

Lever 300 is notched at 314 to receive housing 200 when assembly 100 is in its clamped and locked position. A barrel cradle 316 can be included on lever 300. Cradle 316 nests with the underside of the rifle barrel when assembly 100 is locked onto bayonet lug 12.

As mentioned above, jaw 400 is mounted within slot 204 of housing 200. Specifically, a first transverse hole 402 is aligned with slotted hole 218 in housing 200. A pivot/mounting pin (not shown in FIG. 2) passes through aligned holes 218 and 402 to couple jaw 400 to housing 200. Jaw 400 can pivot about this pin while the pin and jaw 400 can slide back and forth in housing 200. Jaw 400 has a second transverse hole 404 extending therethrough that will be aligned with a hole provided in the head portion of piston/cylinder assembly 500. Accordingly, jaw 400 is hollowed out at 406 to receive therein the head portion of piston/cylinder assembly 500. A pin (not shown in FIG. 2) is passed through hole 404 and the head portion of piston/cylinder assembly 500 to couple jaw 400 thereto.

Jaw 400 also includes a flat plate 408 having teeth 410 protruding from either side thereof. Teeth 410 will cooperate with slots 12A formed on either side of bayonet lug 12 when assembly 100 is clamped/locked onto bayonet lug 12. A retaining tab 412 formed on jaw 400 serves as the contact point for plunger assembly 600. Accordingly, when jaw 400 is mounted in slot 204 of housing 200, tab 412 is positioned opposite sleeve 222.

Plunger assembly 600 includes a lock pin 602 hollowed out to receive a spring 604 therein. A plunger pin 606 slides into lock pin 602 and abuts spring 604. A pin (not shown in FIG. 2) passes through a hole 608 in lock pin 602 and a slotted hole 610 in plunger pin 606. Lock pin 602 is notched at 612 so that a mounting pin (not shown in FIG. 2) that passes through hole 220 in housing 200 rides in notch 612 as lock pin 602 slides axially within sleeve 222. The amount of axial movement of lock pin 602 is equal to the length of notch 612. Plunger pin 606 can be moved axially with respect to lock pin 602 (with or against the bias of spring 604). The amount of axial travel of plunger pin 606 is governed by the length of slotted hole 610. When mounted in sleeve 222, the outboard end 624 of lock pin 602 protrudes outward from axial sleeve 222 while the outboard end 616 of plunger pin 606 protrudes into slot 204 to bear against retaining tab 412 of jaw 400. Note that outboard end 614 is angled similar to a door latch for cooperation with the beginning of notch 314 as lever 300 is pivoted toward housing 200.

Piston/cylinder assembly 500 includes a piston rod 502 having a piston head 504 with a hole 506 formed therethrough. A spring 508 is provided about piston rod 502. Piston rod 502 is fitted into a cylinder 510 and retained therein by threaded coupling to a stop screw 512. Stop screw 512 has a head 514 that can slide within cylinder 510 until reaching an annular lip 516 of cylinder 510. With piston rod 502 coupled to cylinder 510 in this fashion, spring 508 bears against piston head 504 and cylinder 510. Thus, spring 508 biases piston rod 502 out of cylinder 520. If piston rod 502 is pushed into cylinder 520 until the bias of spring 508 is completely overcome, piston/cylinder assembly 500 becomes an axially rigid assembly.

As mentioned above, cylinder 510 is fitted into slot 304 and is pivotally coupled to lever 300 as a transverse cylinder hole 518 is aligned with hole 308 of lever 300 and a hinge pin (not shown in FIG. 2) is passed through aligned holes 518 and 308. Piston head 504 is positioned in jaw 400 at hollowed out portion 406 with holes 506 and 404 being aligned with one another. A mounting pin (not shown in FIG. 2) is passed through aligned holes 506 and 404.

Figure 5:
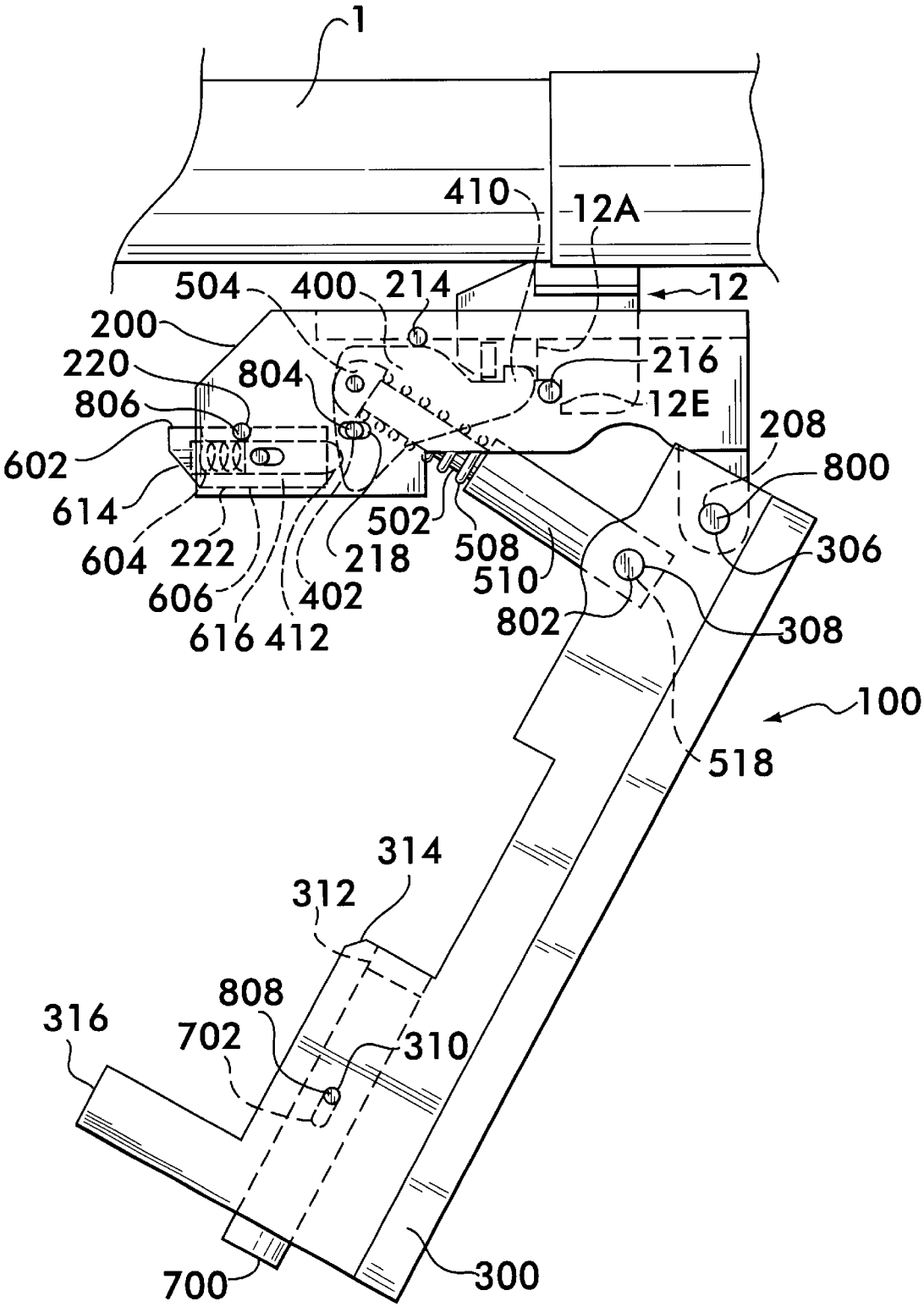
FIG. 5 is a side view of the assembled bayonet lug clamp and mount assembly in its open position with the jaw engaging a bayonet lug such as that depicted in FIGS. 1A–1D.
Figure 6:
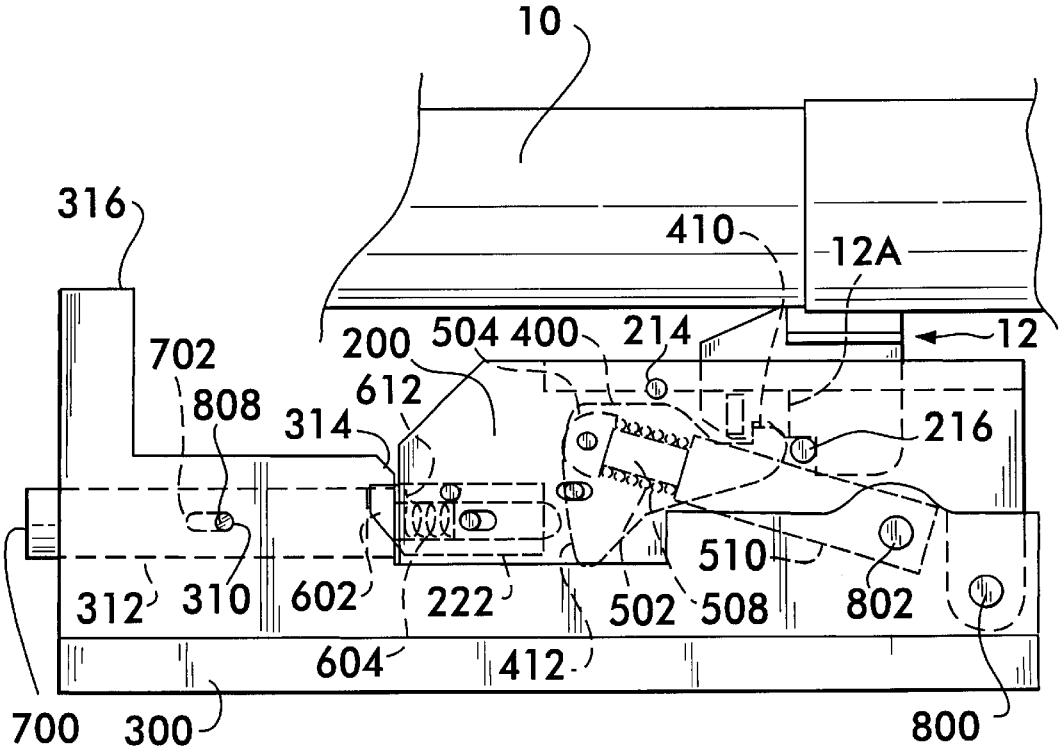
FIG. 6 is a side view of the assembled bayonet lug clamp and mount assembly in its closed and locked position.
Figure 7:
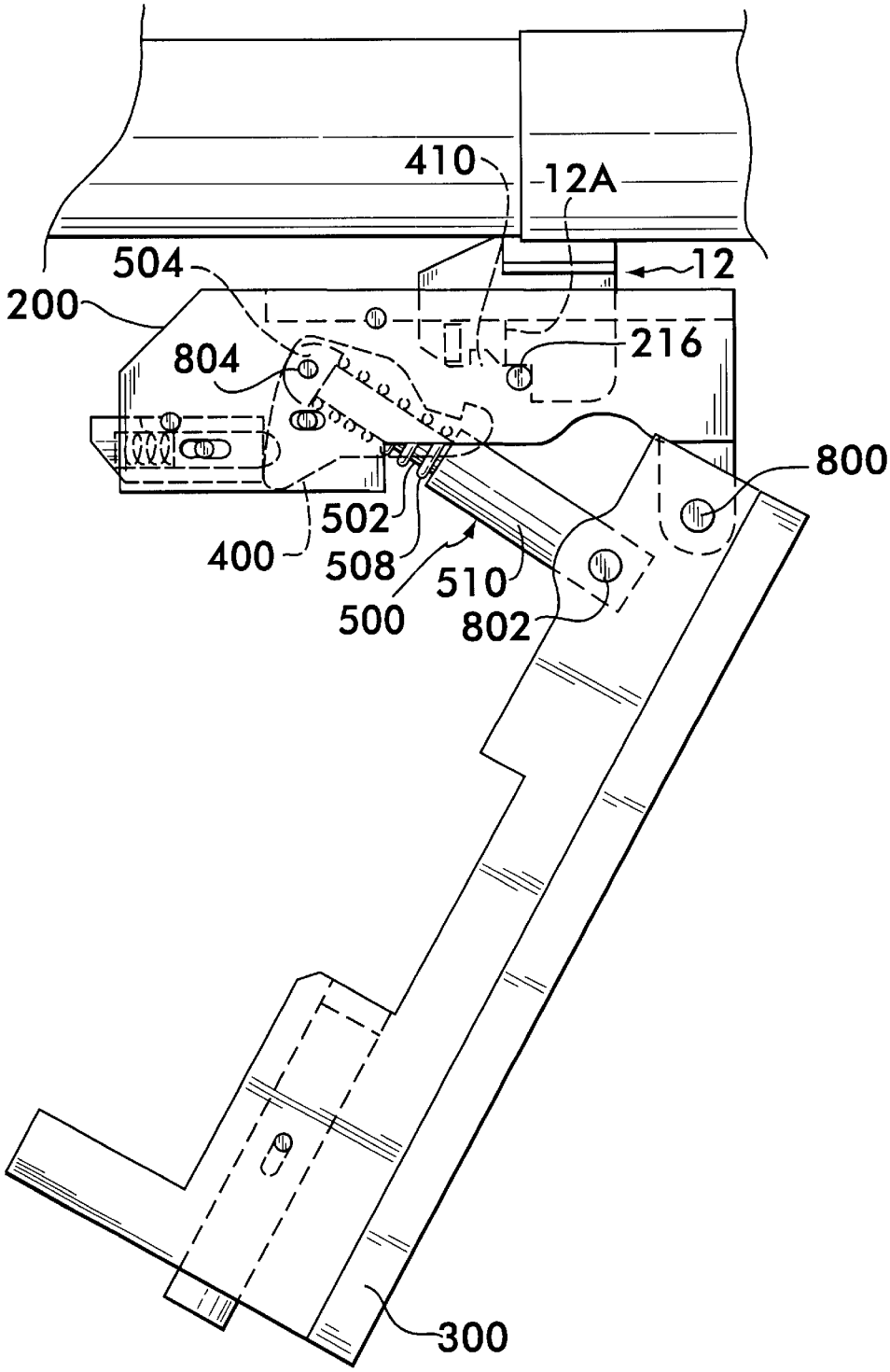
FIG. 7 is a side view of the assembled bayonet lug clamp and mount assembly in its open and hyper-extended position with the jaw disengaged from the bayonet lug so that the housing can be slid therefrom.

Referring additionally now to FIGS. 5–7, assembly 100 is shown in its assembled and open position with jaw 400 engaging bayonet lug 12 (FIG. 5), with assembly 100 locked onto bayonet lug 12 (FIG. 6), and with assembly 100 opened and hyper-extended to disengage jaw 400 from bayonet lug 12 (FIG. 7). Note that in FIGS. 5–7, the various pins not shown in FIGS. 2–4 are now illustrated. Specifically, a hinge pin 800 is passed through aligned holes 208 and 306 of housing 200 and lever 300, respectively. A hinge pin 802 is passed through aligned holes 518 and 308 of cylinder 510 and lever 300, respectively. A mounting pin 804 is passed through aligned holes 402 and 218 of jaw 400 and housing 200, respectively. A pin 806 is passed through hole 220 and cooperates with notch 612 on lock pin 602 as described above. Finally, a pin 808 is passed through aligned holes 702 and 310 in button 700 and lever 300, respectively.

In operation, slot 204 of housing 200 is aligned with a bayonet lug such as bayonet lug 12 described above. Housing 200 is slid onto bayonet lug 12 until stop pin 216 engages the aft portion 12E of bayonet lug 12 as best seen in FIG. 5. In this opened position, outboard end 616 of plunger pin 606 bears against retaining tab 412 of jaw 400 under the force of spring 604. Note that the spring force provided by spring 604 pivots jaw 400 about pin 804 to allow teeth 410 of jaw 400 to engage slots 12A prior to the locking of assembly 100 to bayonet lug 12. The force of spring 604 further causes outboard end 614 of lock pin 602 to protrude from housing 200. The bias of spring 508 bearing against piston head 504 and cylinder 510 tends to keep housing 200 in its open position relative to lever 300.

As lever 300 is pivoted towards housing 200, piston rod 502 is pressed into cylinder 510 against the spring force of spring 508. When spring 508 is fully compressed, piston/cylinder assembly 500 becomes axially rigid as described above and bears up against jaw 400 when housing 200 is fully pivoted to lever 300 as illustrated in FIG. 6. In this way, teeth 410 of jaw 400 are locked into engagement with slots 12A of bayonet lug 12.

As housing 200 reaches notch 314, locking pin 602 is pushed into sleeve 222 against the spring force of spring 604 until locking pin 602 is aligned with axial sleeve 312. At this point, locking pin 602 moves partially into sleeve 312 under the force of spring 604 and slides button 700 axially until pin 808 abuts the end of slot 702. With locking pin 602 engaged in axial sleeve 312, assembly 100 is locked onto bayonet lug 12. To unlock assembly 100, button 700 is pushed into lever 300 to move locking pin 602 out of axial sleeve 312 so that lever 300 can be pivoted away from housing 200.

In order to slide housing 200 off bayonet lug 12, lever 300 must be pivoted to a hyper-extended position shown in FIG. 7. More specifically, lever 300 is pivoted until piston/cylinder assembly 500 opens or is lengthened to its limit to apply a pivoting force to jaw 400, i.e., causes jaw 400 to pivot about pin 804 so that teeth 410 disengage from slots 12A. Then, housing 200 is free to slide off bayonet lug 12.

The advantages of the present invention are numerous. The bayonet lug clamp attaches quickly and easily to the bayonet lug and muzzle of the M-16 rifle without any requiring any modification of the rifle. The system can be installed and locked in place using only one's left or right hand. Attachment at the bayonet lug provides an accessible and optimal mounting location for a variety of rifle accessories. The bayonet lug clamp is locked in its engaged position so that the accessory or accessory mounting rail will not have its position affected by the rifle's firing.

Although the invention has been described relative to a specific embodiment thereof, there are numerous variations and modifications that will be readily apparent to those skilled in the art in light of the above teachings. For example, stop pins 214 and 216 could be eliminated by building stops into housing 200. Lever 300 could integrate a specific rifle attachment as opposed to integrating an accessory mounting rail as described herein. Locking/unlocking mechanisms other than plunger assembly 600 and button 700 could be used without departing from the scope of the present invention. It is therefore to be understood that, within the scope of the appended claims, the invention may be practiced other than as specifically described.

What is claimed as new and desired to be secured by Letters Patent of the United States is:

1. A bayonet lug clamp for use with a rifle having a T-shaped bayonet lug with slots formed in a central portion thereof, said bayonet lug clamp comprising:

a housing configured to slidingly engage the T-shaped bayonet lug;

a lever pivotally coupled to said housing for movement towards and away therefrom;

a jaw movably mounted in said housing, said jaw having teeth protruding therefrom, said teeth alignable with the slots in the bayonet lug when said housing is slid thereon; and a piston/cylinder assembly having a cylinder pivotally coupled to said lever and having a piston slidingly supported partially within said cylinder and coupled to said jaw wherein, when said lever is pivoted towards said housing with said teeth aligned with the slots in the bayonet lug, said piston/cylinder assembly presses said jaw against the bayonet lug as said teeth engage the slots.

2. A bayonet lug clamp as in claim 1 further comprising an accessory mounting rail coupled to said lever and facing away from said housing when said lever is pivoted toward said housing.

3. A bayonet lug clamp as in claim 1 wherein said housing includes at least one stop for abutting a portion of the bayonet lug as said housing is slid thereon, wherein said teeth are aligned with the slots in the bayonet lug.

4. A bayonet lug clamp as in claim 1 further comprising means for locking said housing to said lever after said piston/cylinder assembly has pressed said jaw against the bayonet lug wherein said teeth remain engaged with the slots.

5. A bayonet lug clamp as in claim 4 further comprising means for unlocking said means for locking wherein said lever can be pivoted away from said housing.

6. A bayonet lug clamp as in claim 1 further comprising a spring coupled between said piston and said cylinder, wherein said spring is fully compressed as said lever pivots toward said housing wherein said piston/cylinder assembly becomes an axially rigid assembly.

7. A bayonet lug clamp for use with a rifle having a T-shaped bayonet lug with slots formed in a central portion thereof, said bayonet lug clamp comprising:

a housing configured to slidingly engage the T-shaped bayonet lug in a complementary fashion;

a lever pivotally coupled on an end thereof to an end of said housing for movement towards and away therefrom;

a jaw mounted in said housing for pivoting movement and sliding movement relative to said housing, said jaw having teeth protruding therefrom, said teeth alignable with the slots in the bayonet lug when said housing is slid thereon; and a piston/cylinder assembly having a cylinder pivotally coupled to said lever inboard of said end of said lever, said piston/cylinder assembly further having a piston slidingly supported partially within said cylinder and coupled to said jaw wherein, when said lever is pivoted towards said housing with said teeth aligned with the slots in the bayonet lug, said piston/cylinder assembly compresses to form an axially rigid assembly that causes said pivoting movement and said sliding movement and presses said jaw against the bayonet lug as said teeth engage the slots.

8. A bayonet lug clamp as in claim 7 further comprising an accessory mounting rail coupled to said lever and facing away from said housing when said lever is pivoted toward said housing.

9. A bayonet lug clamp as in claim 7 wherein said housing includes at least one stop for abutting a portion of the bayonet lug as said housing is slid thereon, wherein said teeth are aligned with the slots in the bayonet lug.

10. A bayonet lug clamp as in claim 7 further comprising means for locking said housing to said lever and for bearing against said jaw after said piston/cylinder assembly has pressed said jaw against the bayonet lug wherein said teeth remain engaged with the slots.

11. A bayonet lug clamp as in claim 10 further comprising means for unlocking said means for locking wherein said lever can be pivoted away from said housing.

12. A bayonet lug clamp as in claim 10 wherein said means for locking is a spring-loaded plunger mounted in said housing to continually bear against said jaw.

13. A bayonet lug clamp as in claim 7 further comprising a spring coupled between said piston and said cylinder, wherein said spring is fully compressed as said lever pivots toward said housing wherein said piston/cylinder assembly becomes said axially rigid assembly.

14. An accessory mount assembly for use with a rifle having a T-shaped bayonet lug with slots formed in a central portion thereof, said assembly comprising:

a housing open on an end thereof to slidingly engage the T-shaped bayonet lug in a complementary fashion;

an elongated mounting rail pivotally coupled on an end thereof to said end of said housing for movement towards and away therefrom;

a jaw mounted in said housing for pivoting movement and sliding movement relative to said housing, said jaw having teeth protruding therefrom, said teeth alignable with the slots in the bayonet lug when said housing is slid thereon; and a spring-loaded piston/cylinder assembly having a cylinder pivotally coupled to said lever inboard of said end of said mounting rail, said piston/cylinder assembly further having a piston slidingly supported partially within said cylinder and coupled to said jaw wherein, when said lever is pivoted towards said housing with said teeth aligned with the slots in the bayonet lug, said piston/cylinder assembly compresses to form an axially rigid assembly that causes said pivoting movement and said sliding movement and presses said jaw against the bayonet lug as said teeth engage the slots.

15. An assembly as in claim 14 wherein said housing includes at least one stop for abutting a portion of the bayonet lug as said housing is slid thereon, wherein said teeth are aligned with the slots in the bayonet lug.

16. An assembly as in claim 14 further comprising means for locking said housing to said mounting rail and for bearing against said jaw after said piston/cylinder assembly has pressed said jaw against the bayonet lug wherein said teeth remain engaged with the slots.

17. An assembly as in claim 16 further comprising means for unlocking said means for locking wherein said mounting rail can be pivoted away from said housing.

18. An assembly as in claim 16 wherein said means for locking is a spring-loaded plunger mounted in said housing to continually bear against said jaw.

* * * * *